US007428864B2

(12) United States Patent
Wengrovsky

(10) Patent No.: US 7,428,864 B2
(45) Date of Patent: Sep. 30, 2008

(54) FOOD SERVER

(76) Inventor: Cathryn Wengrovsky, P.O. Box 585, Calverton, NY (US) 11933

( * ) Notice: Subject to any disclaimer, the term of this patent is extended or adjusted under 35 U.S.C. 154(b) by 0 days.

(21) Appl. No.: 11/086,002

(22) Filed: Mar. 22, 2005

(65) Prior Publication Data

US 2005/0229793 A1 Oct. 20, 2005

Related U.S. Application Data

(60) Provisional application No. 60/563,748, filed on Apr. 20, 2004.

(51) Int. Cl.
*A47G 19/00* (2006.01)
*B65D 85/00* (2006.01)

(52) U.S. Cl. ..... 99/646 C; 220/574.1; 220/575; 220/556; 220/212; 108/26

(58) Field of Classification Search ..... 99/483, 99/484, 646 C; 220/574, 574.1, 575, 912, 220/573.1, 593.1, 503, 505, 554, 556, 254.1, 220/254.3, 212, 502; 269/302.1, 289 R; 108/26, 25, 24

See application file for complete search history.

(56) References Cited

U.S. PATENT DOCUMENTS

| | | | | | |
|---|---|---|---|---|---|
| 1,768,976 | A * | 7/1930 | Cuthbertson | 220/575 |
| 2,817,744 | A * | 12/1957 | Free | 219/439 |
| 3,577,908 | A * | 5/1971 | Burg | 99/333 |
| 4,483,440 | A * | 11/1984 | Ware | 206/233 |
| 4,653,737 | A * | 3/1987 | Haskins et al. | 269/13 |
| 4,747,352 | A * | 5/1988 | Guidry et al. | 108/26 |
| 5,499,578 | A * | 3/1996 | Payne | 99/537 |
| 5,499,666 | A * | 3/1996 | Foster et al. | 141/98 |
| 6,533,120 | B1 * | 3/2003 | Csengeri | 206/565 |
| 6,681,684 | B1 * | 1/2004 | Chen | 99/448 |

* cited by examiner

*Primary Examiner*—Reginald L Alexander
(74) *Attorney, Agent, or Firm*—Alfred M. Walker; Lee Grosskreuz Hechtel

(57) ABSTRACT

A server apparatus for food items which provides a deposit location for unwanted, discardable, or inedible portions of the food, or ancillary utensils such as tooth picks, and is convenient, sanitary and appealing for serving food.

42 Claims, 8 Drawing Sheets

Fig. 1
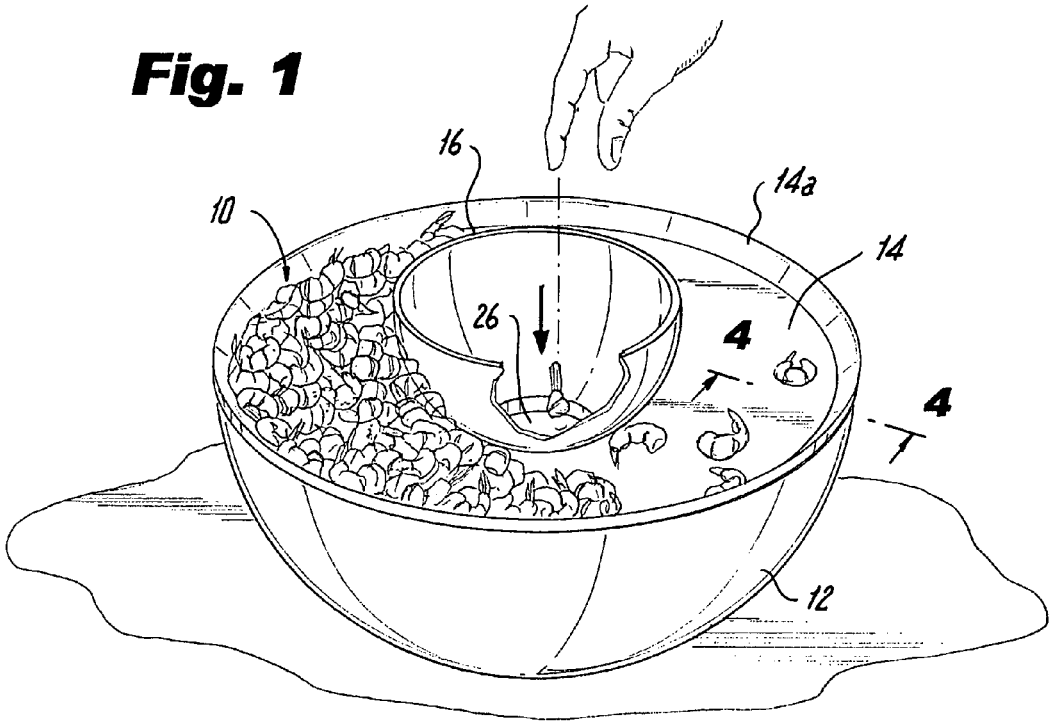
Fig. 2
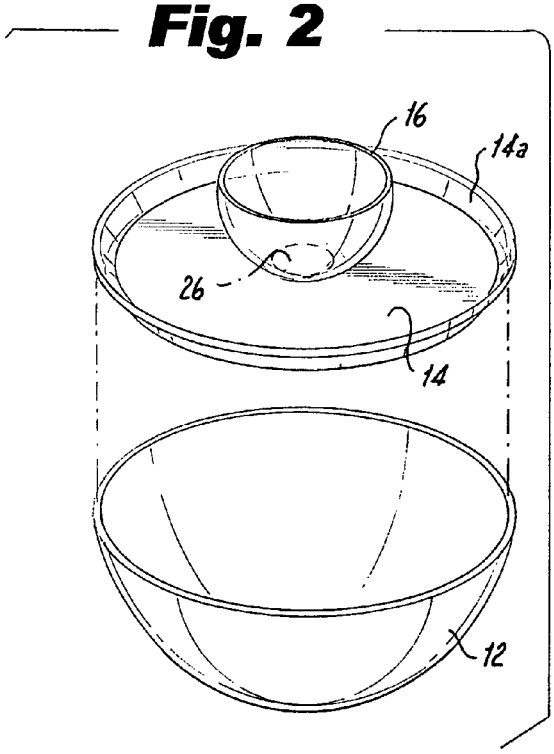
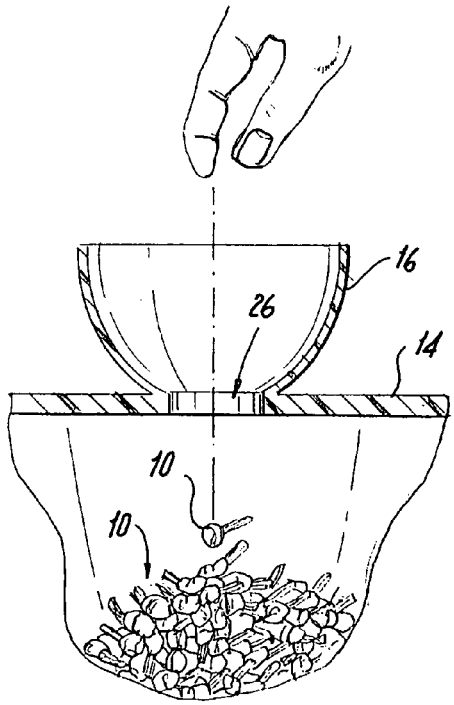
Fig. 3

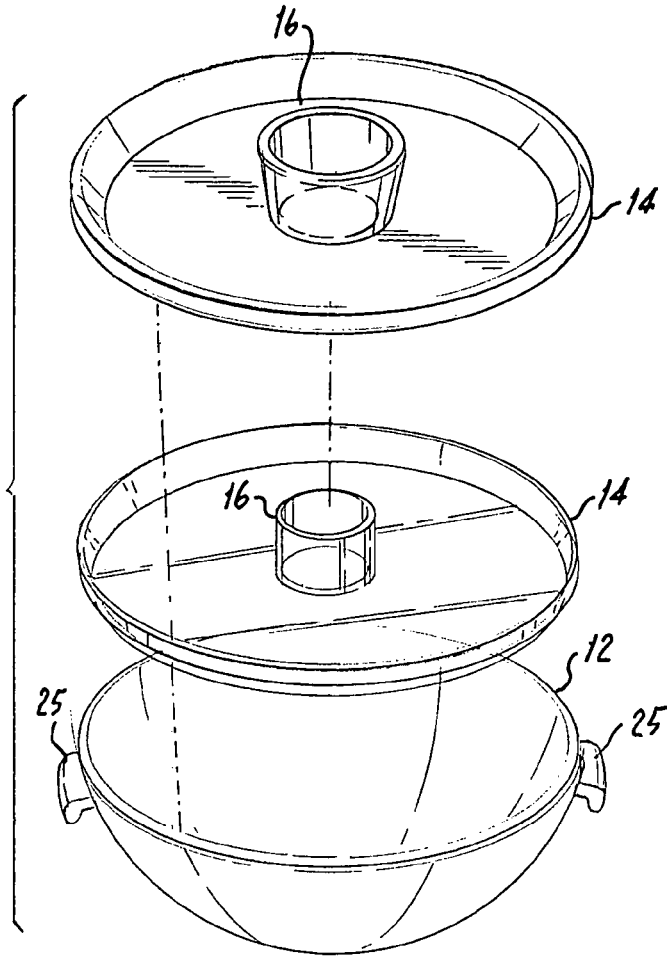
Fig. 18
Fig. 19
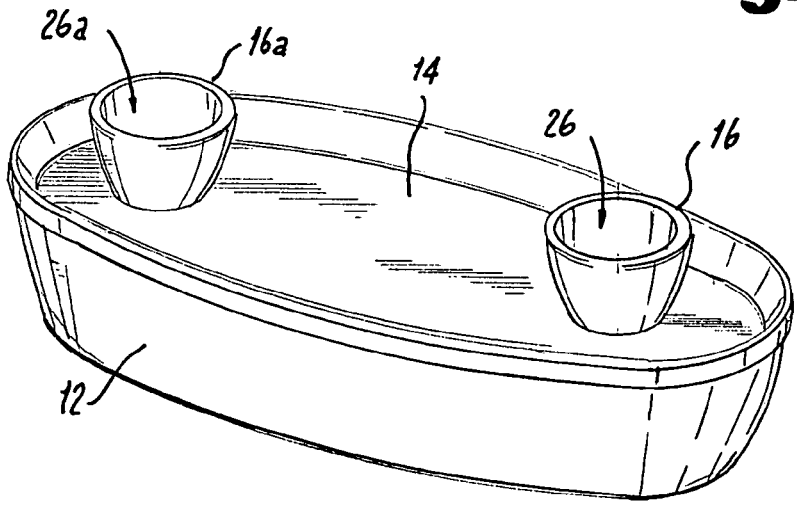

FOOD SERVER

This application is related to Provisional Patent Application No. 60/563,748, filed by the present Applicant on Apr. 20, 2004.

FIELD OF THE INVENTION

This disclosure relates to a food serving apparatus which may both serve food and provide a separate, disposal location for unwanted portions of food such as shells, peelings and the like.

BACKGROUND

Food is often presented in large serving dishes or bowls holding quantities of that food. When serving food informally or in a party setting, the food may often include inedible portions such as shells, tails, peels and the like. Large serving dishes do not provide a disposal area for these inedible items, which are often discarded into a napkin, a paper plate if available, pockets and occasionally the floor. Generally, inedible or discardable portions entail the usage of a separate plate or garbage receptacle to dispose of shells and the like. This method is inherently inefficient, as the usage of two items may take up valuable table or counter space. Moreover, the piling up of discarded portions of food items can be unsightly and unsanitary.

OBJECTS OF THE INVENTION

It would be advantageous to provide an article that may serve food items as well as provide a sanitary location for disposal of the unwanted portions of the food.

SUMMARY

The present disclosure relates to a server apparatus for displaying and serving food items that provides a convenient and sanitary location for shells separate from food items comprising a food server member, at least one chute attached to the server member; and a base member that is attached to the server member. The food refuse, shells and the like may be deposited into the chute which leads to the base member where the shells are retained until the base member is filled up to capacity with the shells. Alternatively, the chute and/or the base member may be detachable from the server member. In a further alternate embodiment the server member may be joined integral with the base member. Additionally, as a further option, the base member, the server member and the chute may be formed as a single integral unit, with an optional trap door to remove discarded shells.

DESCRIPTION OF THE DRAWINGS

The present disclosure can best be understood in connection with the accompanying drawings. It is noted that the invention is not limited to the precise embodiments shown in drawings, in which:

FIG. 1 is a perspective view of the food server apparatus.

FIG. 2 is an exploded view of FIG. 1.

FIG. 3 is a sectional elevational view of waste dropping into the base member via the chute.

FIG. 18 is an exploded view of an embodiment of the serving apparatus with handles on bowl.

FIG. 19 is a perspective view of an elongated unit with multiple chutes.

DESCRIPTION

Figure 4:
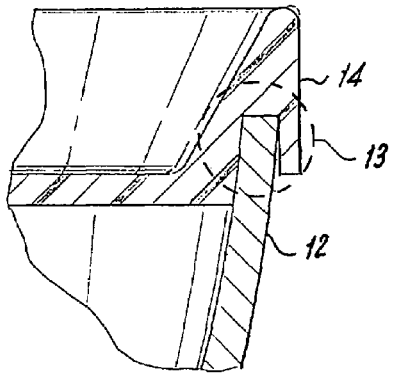
FIG. 4 is a view of local sectional elevational of attachment means of server member to the base member, taken along the view arrows shown in view line "4-4" of FIG. 1.

The present disclosure relates to a serving apparatus for food items which have an unwanted and/or inedible portion, such as pistachio and other types of nuts, shrimp, cherries, olives, and many other foods with shells, seeds, pits, stems, packaging, or other discardable coverings or segments and the like (hereinafter referred to as "shells"). This serving apparatus may also provide a location for clean and convenient disposal of toothpicks from hors d'oeuvres and/or candy or chocolate wrappers. The serving apparatus allows foods to be served in a convenient, sanitary and appealing fashion.

According to FIG. 1, the serving apparatus includes at least one container or holder for food items 10, referred to as a server member 14, and also includes a chute member 16, and a base member 12. The server apparatus may be shaped in any configuration that can retain or hold food items 10 on the server apparatus easily, and in alternative embodiments can include a raised lip 14*a* along the edge of the server member 14 to assist in retaining food items 10 in the server member 14. In other embodiments, the server member 14 may be concave, and/or include a textured surface to assist in the retention of the food items 10. The server member 14 includes at least one aperture or hole 26 that transverses upper and lower surfaces of the server member 14. The aperture 26 may be located in any convenient position through the server member 14. A mating base member 12 can take a similar shape to allow the base member 12 and the server member 14 to be positioned to maintain contact with each other during use.

A chute member 16 may be removably inserted into an aperture 26 of the server member 14. The chute member 16 is generally tube or funnel-shaped and when inserted in to the aperture 26, the chute member 16 extends upwardly from the surface of the server member 14. In one embodiment, the portion of the chute member 16 extends above the upper surface of the server member 14 to a sufficient height to prevent food items 10 from falling into the chute member 16 accidentally and/or prevent shells from falling in to the food items 10 accidentally. The chute member 16 may also be positioned to allow it to extend beyond the lower surface of the server member 14 to guide the shells into the base member 12. The generally funnel-shaped form of the chute member 16 may have a diameter of sufficient width to allow discarded food items 10, such as shells and other such refuse, to pass through to the base member 12 without clogging or blocking the chute member 16.

The chute member 16 may be formed into any variety of shapes such as square, rectangular, round, elliptical, oval, conical, cylindrical, bulbous, spherical, irregular, shaped as desired, or shaped according to a theme or event.

Generally, the server apparatus may be formed of any food-compatible material including, for example, plastic, ceramic, steel, aluminum, Plexiglas, fiberglass, glass, wood, rubber, paper, cardboard, STYROFOAM®, with or without food compatible contact surface coatings, such as TEFLON® or silicone, and combination thereof. However, other materials may be utilized, and the server member 14, chute 16, and base member 12 need not be constructed of the same material or materials.

Figure 14:
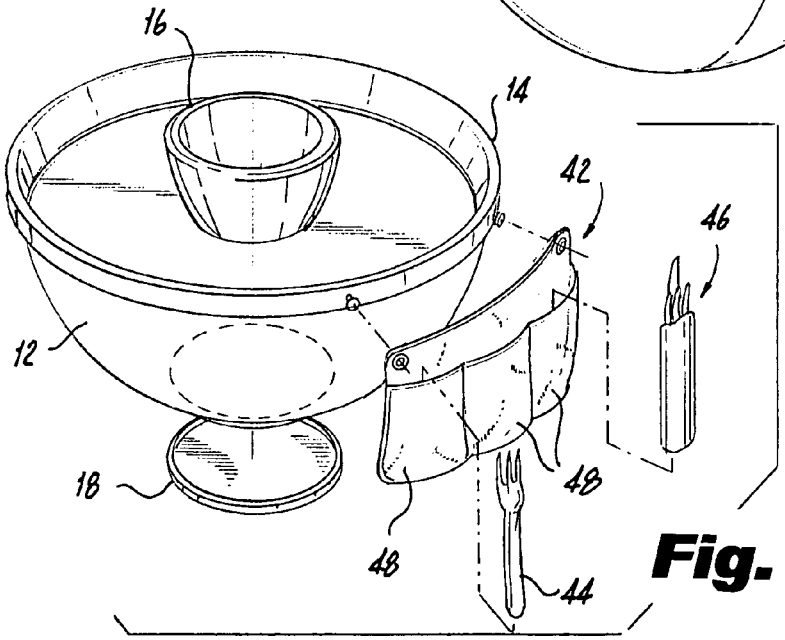
FIG. 14 is a perspective view of the server with removable pockets for napkins and toothpicks.

FIG. 2 depicts the attachment between the server member 14 and a mating base member 12 to form a non-permanent seal. The server member 14 and the chute member 16 are positioned onto the upper portion of the base member 12. The base member 12 is formed to have a concave shape or a depth-forming, and having both inner and outer surfaces. The server member 14 may be positioned onto the upper most edge of the base member 12 or fitted within the diameter of the base member 12 to form the serving apparatus. The server member 14 and base member 12 may form a seal together by snapping, interlocking and the like. The serving apparatus provides a food-serving surface on the upper surface of server member 14 and a containment portion in base member 12 for any shells which are deposited into the base member 12 via the chute 16. While server member 14 is shown in FIG. 2 as being detachable from base member 12, in an alternate embodiment server member 14 may be joined integral with base member 12, as shown in FIG. 14, Additionally, as a further option, base member 12, server member 14 and chute 16 may be molded, cast or otherwise formed as a single integral unit (not shown).

As shown in FIG. 3, once assembled, the server apparatus with the server member 14 and the chute member 16, the base member 12 retains discarded portions of the shells therein as a holder portion that is separate from the server member 14. The base member is formed of a sufficient depth to contain a quantity of shells to allow use without the necessity of frequently emptying the base member 12. FIG. 3 depicts a sectional view of the path which the shells follow when dropped into the chute 16 and are retained in the base member 12. In one embodiment, the base member 12 can be deeply concave to provide a receptacle to act as a holder portion and contain a relatively large quantity of discarded shells, such that the base member 12 need not be emptied frequently.

Figure 7:
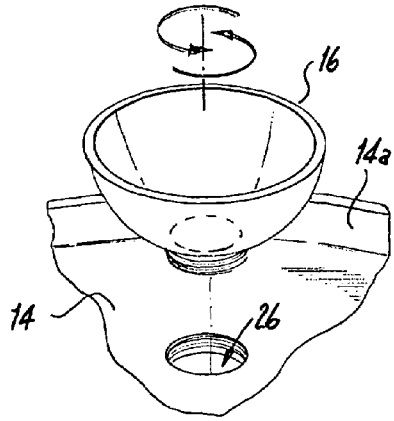
FIG. 7 is a local perspective view of removable, threaded chute spaced from the aperture through the server member.

In another alternate embodiment, as shown in the cross sectional view of FIG. 3, the server member 14 and chute 16 may be molded as a single, integral piece, which is removably attached to the base member 12. In contrast, the chute 16 may be removable, from server member 14, such as shown in FIG. 7.

The dashed circle 13 of FIG. 4 depicts a region of a seal 13 formed when a server member 14 and a base member 12 are mated for connection to retain shells that are deposited into the base member 12. In alternative embodiments, the server member 14 may attach to the base member 12 by any of a variety of other attaching means (not shown), such as by snapping in, screwing in, fitting into grooves, being secured with locking tabs, secured with other fasteners, hinge means, or through the usage of magnets.

Figure 5:
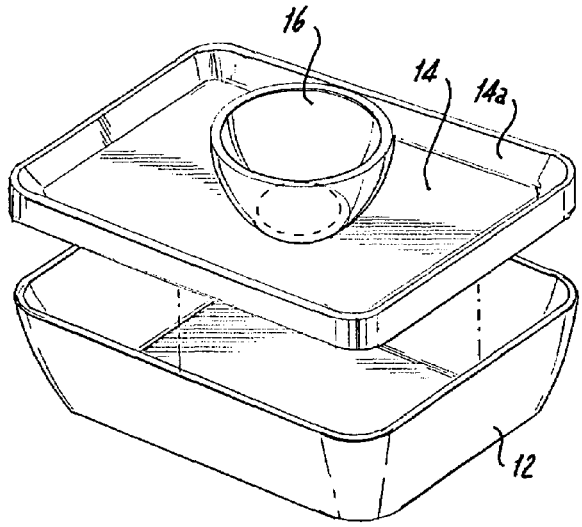
FIG. 5 is a perspective exploded view of an alternate, rectangular embodiment.

As shown is FIG. 5, the server member 14 of the server apparatus may be formed in a number of different shapes as desired, such as the rectangular shape depicted therein, for ease of use, transport, and storage. The server member 14 may be of any of a variety of shapes, such as square, rectangular, round, elliptical, oval, conical, cylindrical, bulbous, spherical, irregular, or shaped as desired, or according to a theme or event, such as a heart or a shamrock. The chute 16 may also be formed in any desired shape and need not be formed into the same shape as either the server member 14 or the base member 12. in one embodiment, the server member 14 and the base member 12 may be formed in a similar diameter and/or shape for secure placement thereon. However, in alternative embodiments, the server member 14 may be wider or narrower than the base member 12 with the attachment means chosen accordingly. As shown in Figures 1, 2, 5, 18 and 19, the height of lower base member 12 at its highest point is significantly less than the width of upper server member 14 and the portable food server container and receptacle 10 has a geometric shape being dimensioned of a pre-determined maximum portable size for being carried by hand by a user. In one embodiment, the server member 14 may also be molded to fit or fit over a base member 12, such as a previously existing bowl, i.e., standard-sized mixing bowls or common bowls and the like.

Figure 6:
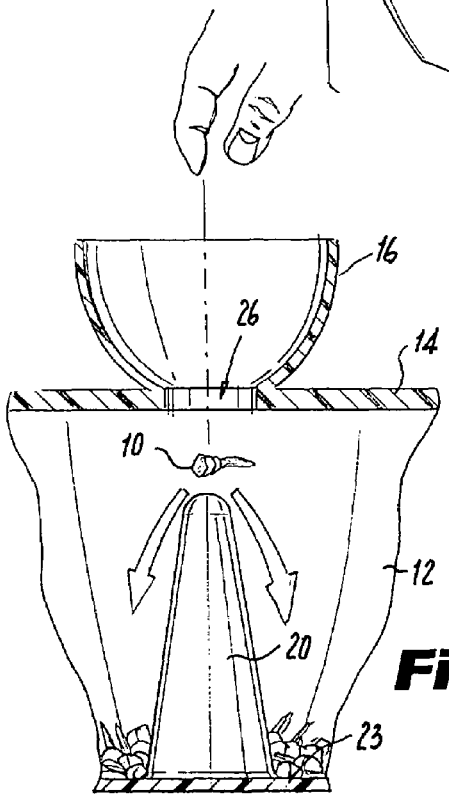
FIG. 6 is a sectional elevational view showing a cone projection in the base member.

Furthermore, as shown in FIG. 6, the base member 12, may further include a non-skid surface 23 on a bottom exterior surface and/or sides of an exterior surface to prevent sliding and enhance a secure gripping surface. This will help keep the apparatus stationary upon a table or other flat surface, particularly when the server apparatus is utilized by multiple people. The server apparatus may also include additional gripping surfaces on an exterior portion of the base member 12 such as friction ridges, bumps, other texturing, and the like.

As also shown in FIG. 6, one embodiment of the base member 12 may include a raised or conical portion 20 formed within the concavity of the base member and generally located at a mid-point of the base member 12. The conical portion 20 may be formed with or without vertical slants radiating outward therefrom to direct shells downward into the base member 12. A plurality of vertical slants may be positioned on the conical portion. Where slants are present on the conical portion 20, they further assist in guiding the shells into the base member 12 and can direct the shells to settle in an outer portion of the base member 12. Therefore, the conical portion 20 assists in efficient filling of the base member 12 and prevents clogging of the base member 12 that is immediately below the chute 16.

As shown in FIG. 7, the chute 16 may be attached to the server member 14 by screw threads. In alternative embodiments, the chute 16 may be attached to the server member 12 by any means including snap-in, clip-in, lock-in means and the like.

Figure 8:
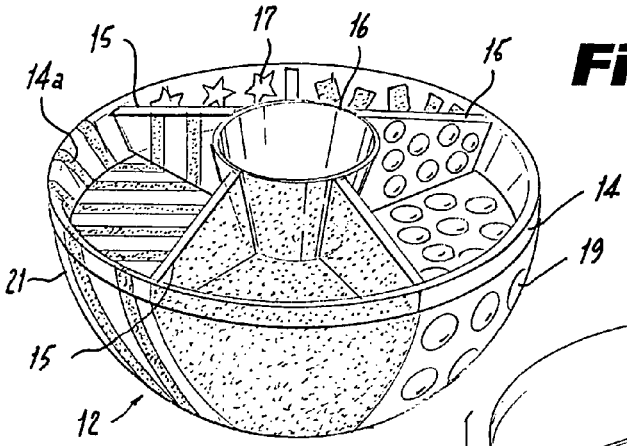
FIG. 8 is a perspective view of an alternative embodiment showing a decorated segmented server member and base member.

FIG. 8 depicts the server member 14 having several partitions 15 or segments to keep different types of food items 10 separate from one another. The number of partitions 15 or segments may be varied as desired. The partitions 15 in the server member 14 allow various different types of food items 10 to be served at one time. Additionally, the server member 14, chute 16, or base member 12 may also bear decorations 17 thereon such as colors, text, designs, and combinations thereof. For example, the food server may bear indicia relating to a food, holiday, event, or occasion with which the server apparatus is utilized, as well as corporate or other advertising 19.

Any or all components of the serving apparatus may be colored in accordance with a particular holiday. Moreover, any of the components of server apparatus, such as base member 12, server member 14 and/or chute 16, may be colored in accordance with particular sports teams' colors or logos, and may bear designs in accordance with specific events or holidays.

Figure 9:
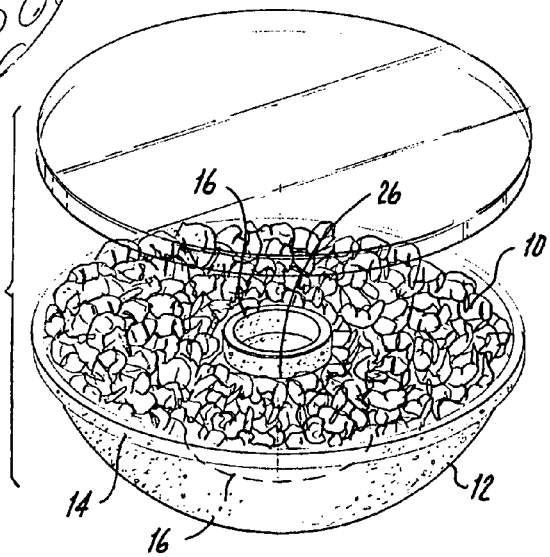
FIG. 9 is a perspective view of a disposable STYROFOAM® unit having a shrink-wrap covering, with the chute inverted under the server member for transport.

As shown in FIG. 9, a server member 14 may be formed in a disposable STYROFOAM® wherein the chute 16 is stored within the base member 12 during transit and then may be placed on the upper surface of the server member 14 for use as a food server apparatus which provides a sanitary location for shells and the like. The server apparatus may be shrink-wrapped for ease of transport, with the chute 16 inverted under the server member 14. This disposable form provides a server apparatus that requires no cleaning afterward and no storage space.

Figure 10:
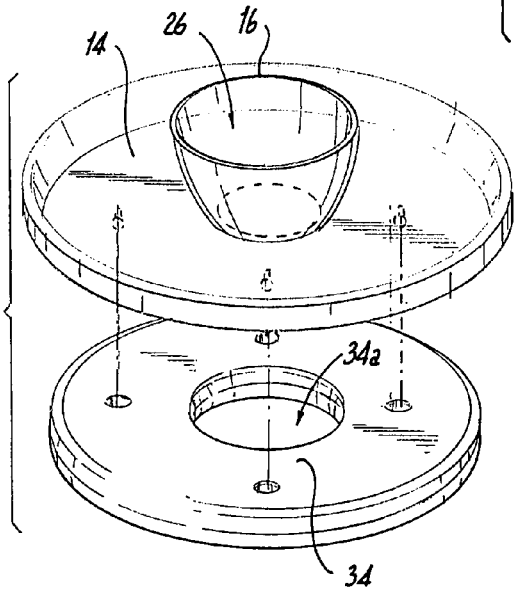
FIG. 10 is a local perspective cutaway view of the server member with a cooling element.

As shown in FIG. 10, the server apparatus may include a cooling element 34 or means to maintain food items 10 at cool temperatures, where necessary or desired, while in the server member 14. The cooling means may be accomplished by electrical and/or chemical means, such as a refrigeration unit, or freezer packs which often contain gels, such as those that are used for lunch boxes. The cooling means includes an aperture 34*a* therethrough to allow shells to pass downward through the chute 16 and be retained in the base member 12. The cooling means 34 may be situated between the server member 14 and the base member 12, thereby cooling any food items 10 located in the server member 14 from below. A server apparatus, which includes a cooling means 34, may be ideal for transporting and/or serving food items 10 which must be kept cold to be safely eaten, such as shrimp or clams, and toothpicks used as utensils to serve the food items 10, may be deposited in the chute 16 and retained in the base member 12 as refuse.

Figure 11:
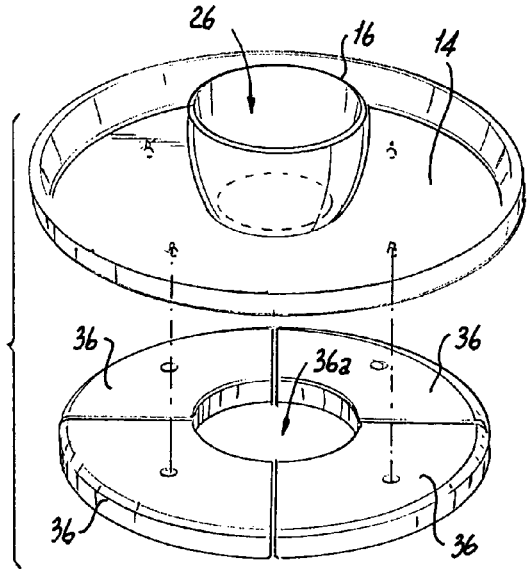
FIG. 11 is a local perspective cutaway view of the server member with a heater element.

As shown in FIG. 11, the server apparatus may also include a heating element 36 or means, such as, for example, an electrical coil to continually maintain heating or heat-retaining inserts, which can form a layer between the server member 14 and the base member 12. The heating means 36 includes an aperture 36*a* therethrough to allow shells to pass through the chute 16 and into the base member 12. The heating means 36 maintains food items 10 at a desired temperature in the server member 14 while food is served and displayed. For example, hot hors d'oeuvres may be served in the server member 14 and individual toothpicks used as food-handling utensils may be disposed of by conveniently dropping the toothpicks into the chute 16, which lead to the base member 12 and are retained therein until the shells are emptied. A server apparatus which includes heating means 36 is also conveniently used to transport and serve while the food has been maintained at a desired temperature.

Figure 12:
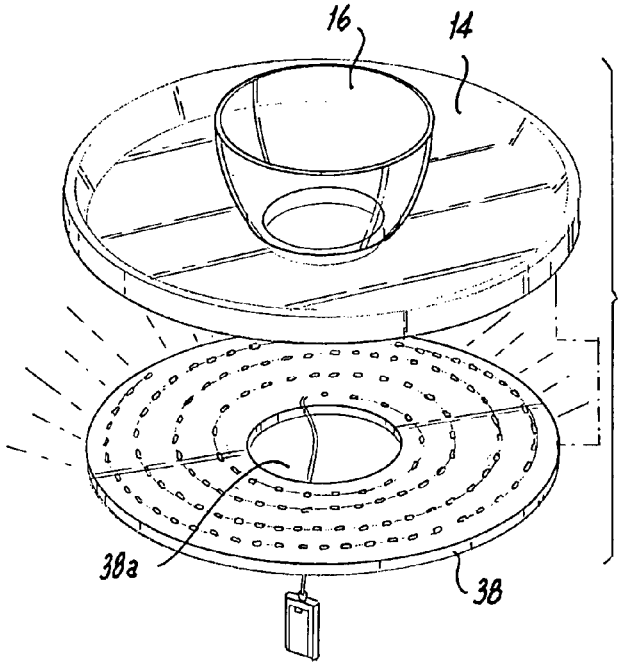
FIG. 12 is a local perspective cutaway view of the server showing LED's and a power source.

As depicted in FIG. 12, the server apparatus may also include an illumination means 38, such as LEDs, glow-in-the-dark designs, battery operated bulbs, or the like. Such illumination may be particularly attractive and useful while serving and displaying food items 10 for parties or celebratory events, as the same may be highly decorative in nature in addition to being functional. The illumination means 38 may be situated between the server member 14 and the base member 12, and include an aperture 38*a* therethrough to allow the shells deposited into the chute 16 to pass easily into the base member 12 for temporary storage therein.

Figure 13:
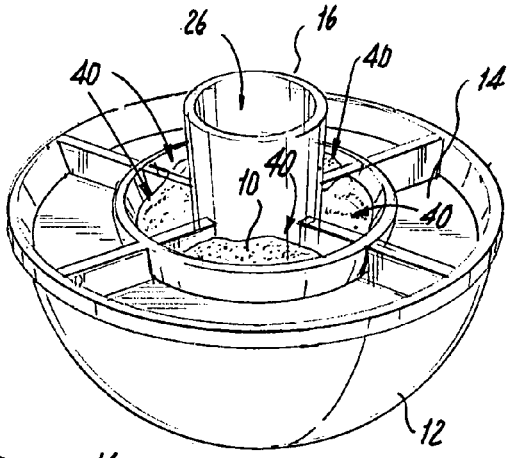
FIG. 13 is a local perspective view of the chute with an integral condiment storage cup.

As shown in FIG. 13, the server member 14 may include a plurality of segmented compartments 40 on its upper surface to contain and maintain separate a variety of salsas, dips, condiments and the like as well as food items 10 to be combined with those condiments. The plurality of segmented compartments 40 are conveniently positioned to encircle the chute member 16 for easy deposit of any shells and the like.

As shown in FIG. 14, the server member 14 may also include a storage accessory 42 to present and provide ancillary non-food articles such as, for example, utensils 44, nutcrackers (not shown), toothpicks 46, sauce packets (not shown), crackers (not shown), and napkins (not shown). A pocket means 48 may be provided to hold such items conveniently on the server member 14 and may be mounted to the vertical wall of the server member 14 or the base member 12 by any convenient means including snap-in, lock-in, VELCRO® and the like. The storage accessory 42 may include a plurality of separate pockets 48 to segregate utensils 44 from each other and other items for ease of use.

In yet another embodiment shown in FIG. 14, the entire assembly may be molded as a single unit, forming the server member 14, a chute member 16, and a base member 12 in one piece and includes an openable trap door 18, located on the base member 12 to remove the shells and empty the shells out of the base member 12. While trap door 18 is shown being openable from base member 12 to permit emptying of the shells, in a further embodiment a similar trap door 18 (not shown) may be joinable to plug hole 26 at the bottom of chute 16, in case chute 16 is temporarily used alternatively as a closed condiment compartment containing onion dip, salsa and the like for food items not having shells, such as corn chips, potato chips and the like.

Figure 15:
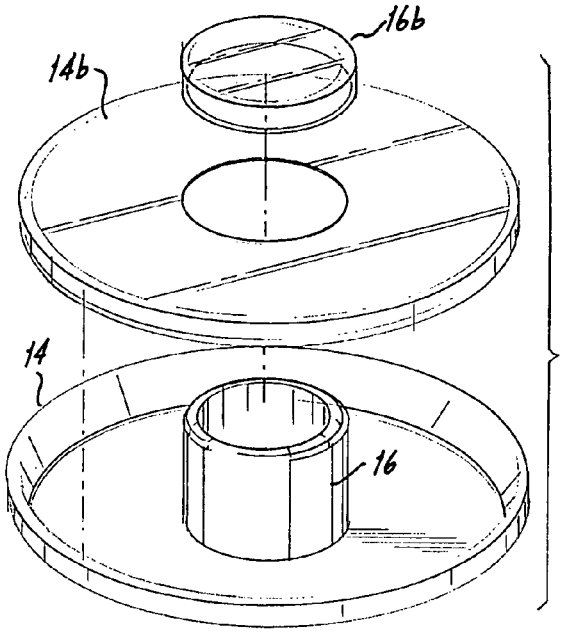
FIG. 15 is an exploded perspective view of server member and chute with removable covers.

As shown in FIG. 15, the server member 14 may include removable cover 14*b* to protect the food items 10 before serving, for example it may be necessary to prevent insects from coming in contact with the food items 10 or prevent the food items 10 from spilling of the server member 14 while transporting the food items 10 to the desired location which may be another room or a another location. A cover cap 16*b* may be provided for chute 16.

Figure 16:
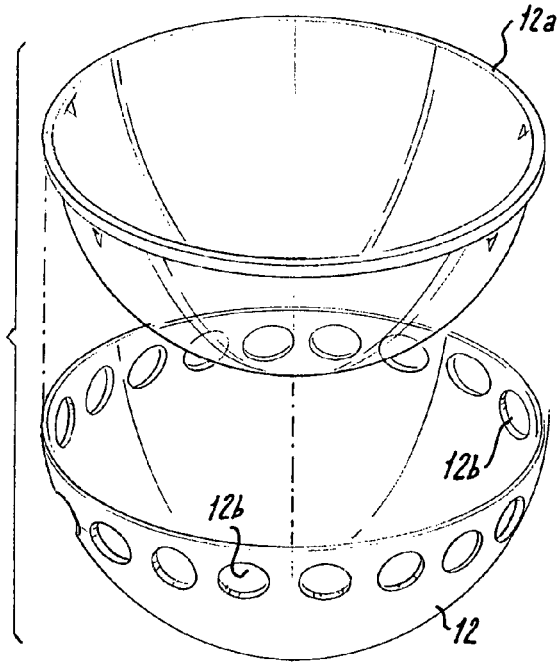
FIG. 16 is an exploded view of the base member with a disposable liner and window in bowl.

FIG. 16 depicts a view of the base member 12 having a disposable liner 12*a* to facilitate sanitary and easy removal of discarded portions of shells retained therein. The disposable lining may be constructed of paper, waxed paper, plastic, fabric and the like. FIG. 16 also depicts an indicator window 12*b* or windows in the base member 12 to view the level of the shells and ensure prompt emptying of the base member 12 and prevent overflowing of the shells.

Figure 17:
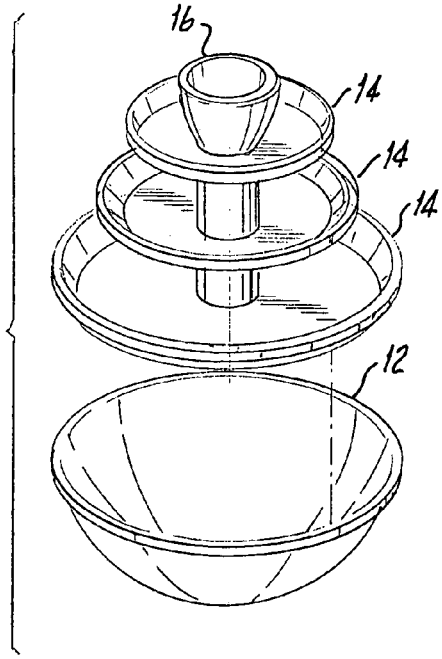
FIG. 17 is a perspective view of a multi-tiered server.

FIG. 17 depicts yet another embodiment of the serving apparatus which may be a multi-tiered server apparatus with multiple server members 14, to provide an attractive mode of serving a large amount of food items 10 while maintaining close proximity to the chute 16 for disposal of the shells. This embodiment provides a sanitary mode of disposing shells readily, rather than having multiple serving bowls and scattered (and often spilt) disposal bowls. Moreover, where desired, the base member 12 may include a disposable lining similar to liner 12*a* of FIG. 16.

As shown in FIG. 18, the food server apparatus may also include at least one handle 25 to facilitate lifting and presenting the server apparatus. For the purposes of example only, the base member or server may comprise two handles 25 on the exterior, opposite one another.

Additionally, as shown in FIG. 19, the serving member 14 of the server apparatus may include a plurality of chutes 16, 16*a*, to provide convenient disposal locations within in reach of multiple users. In alternative embodiments, a server member 14 may be formed having multiple apertures 26 or 26*a* to accommodate multiple chutes 16 or 16*a*, as desired.

Figure 20:
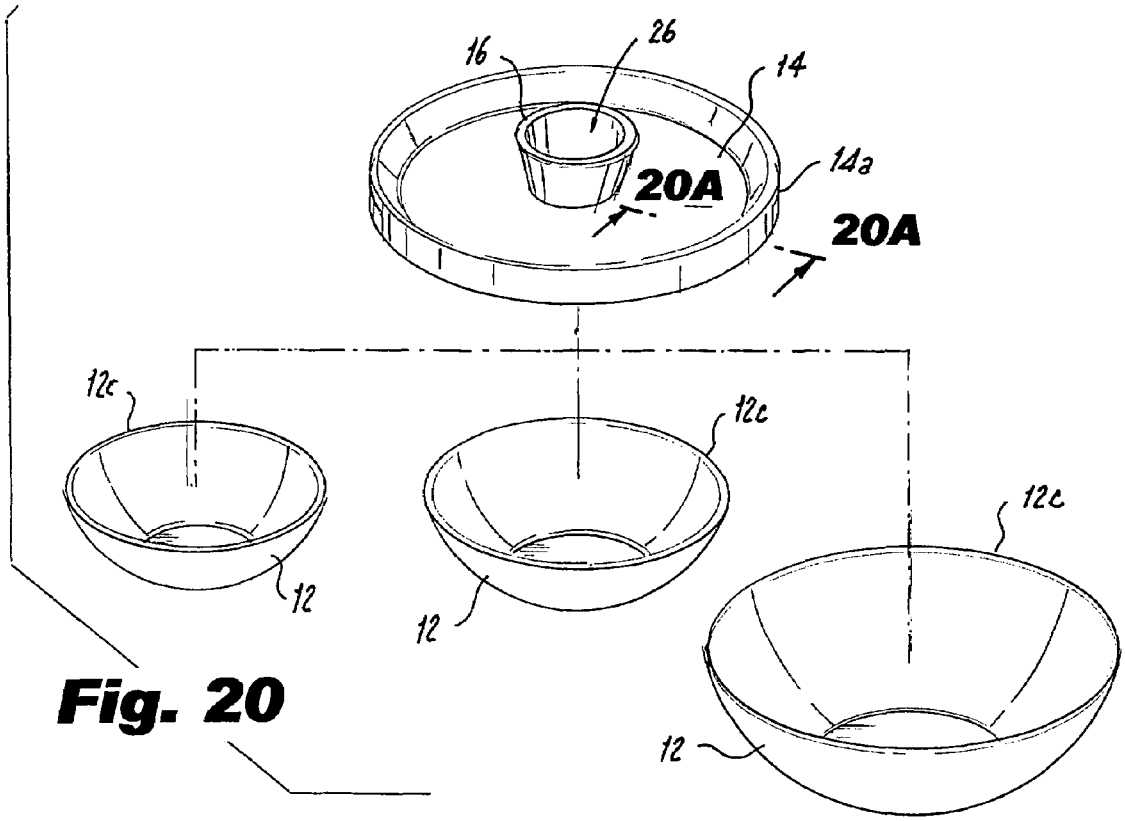
FIG. 20 is a perspective view of the universal server, which is adaptable to different size bases.
Figure 20A:
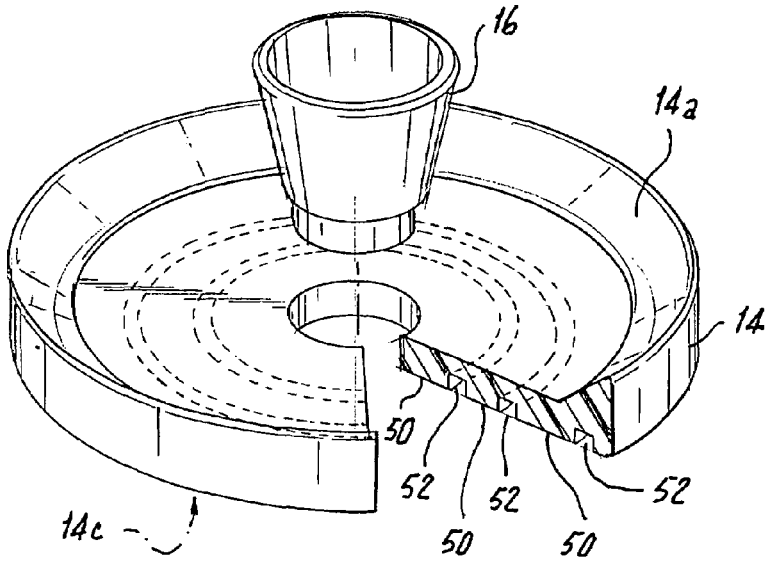
FIG. 20A is a cut-away view of the universal server which is adaptable to different size bases, taken along the view arrows shown in view line "20A-20A" of FIG. 20.

In other embodiments shown in FIGS. 20 and 20A, the server member 14 may be used and be considered adaptable to a variety of base members 12, such as bowls, when used in conjunction with the chute 16, as shown in FIG. 20. FIG. 20A depicts a cut-away view of the server apparatus which may be adapted to a plurality of base members 12 of various sizes and edge diameters, and may include a plurality of ridges 50 with edge-retaining recesses 52 on the lower surface 14*c* of the server member 14, which is the surface opposite of the food serving surface. The ridges 50 may slide against or interact with the upper edge 12*c* or lip of the base member 12 to provide a more secure fit between the server member 14 and the base member 12 used.

Figure 21:
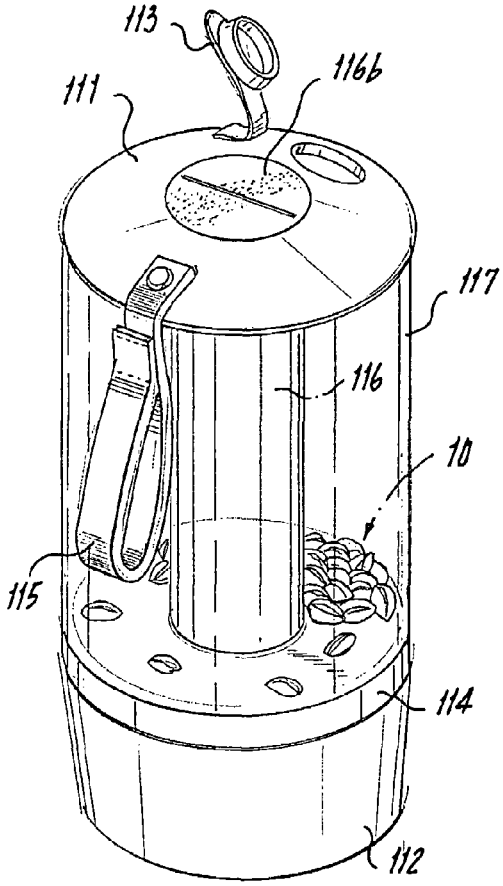
FIG. 21 is a perspective view of a portable serving apparatus unit.
Figure 22:
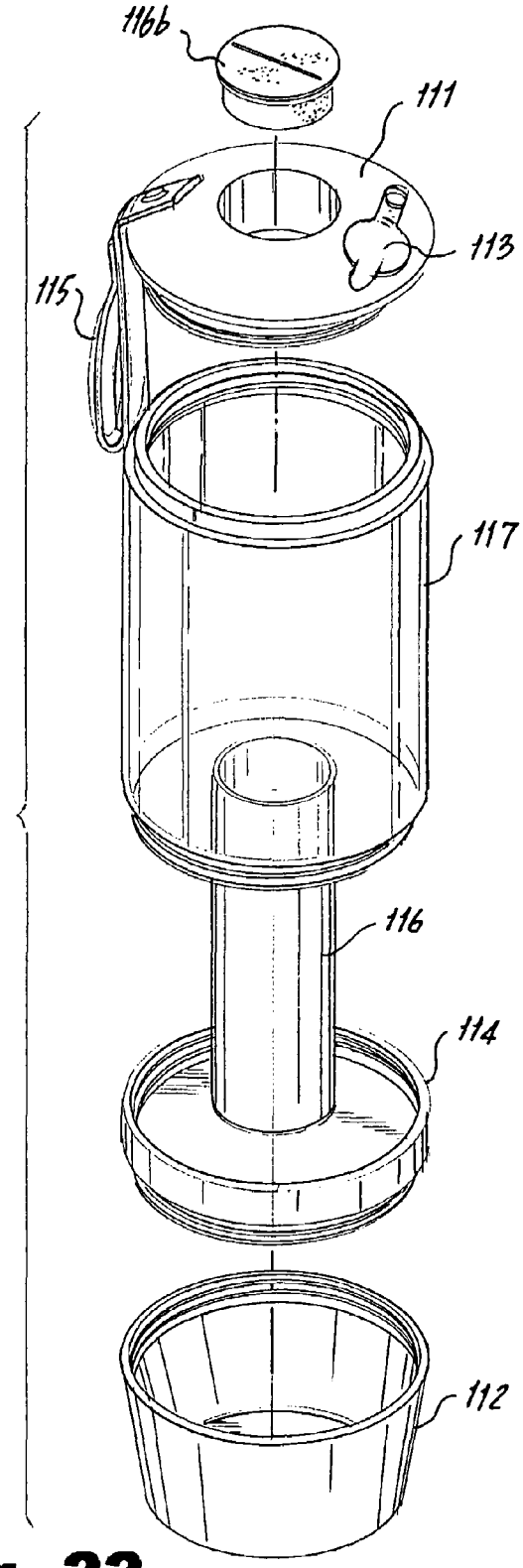
FIG. 22 is an exploded view of components of the portable serving apparatus unit of FIG. 21.

Additionally, as shown in FIGS. 21 and 22, a portable carry kit of a server apparatus may be provided, including a top cover 111 having a connected removable cap 113 with a handle 115 attached to a transparent food item viewing portion 117 enclosing food server member 114 and chute 116, which may be optionally elongated. Chute 116 preferably includes cover cap 116*b*. Lower base member 112 may be removably attached to transparent food item viewing portion 117.

In the foregoing drawings, server member 14, server member 114, chute 16, chute 116, base member 12, and/or base member 112 may each be transparent, translucent or opaque. In another embodiment, the base member 12 or base member 112 alone may be transparent, translucent or opaque to determine and monitor the level of shells which may be present in the base member 12 or base member 112.

It will be appreciated that when the above-described parts perform in unison, the serving apparatus provides a neat and convenient way to consume foods with inedible portions, be the portions part of the food itself (i.e. shells, nuts, pits, etc.) or part of the food's packaging (i.e. paper or foil wrappers, etc.). For example, pistachio nuts are placed in the server apparatus. The user selects a pistachio nut from the server, removes the shell, eats the nut, and discards the shell into the chute. The shell passes through the chute into the base member. When some or all of the nuts have been consumed, one may remove the contents of the base member into a garbage or compost pile. The containment of the shells conveniently in the base member allows food service to be done economically and in a small area since only one apparatus is required. The serving apparatus is also highly useful for food service and shells storage while traveling and/or serving food outdoors. The surroundings of the vehicle or eating area remain clean and transport of additional apparatus is not required. Additionally, the server apparatus may be provided and sold in conjunction with related food, for example, the server apparatus may pre-filled by a caterer or grocer for convenient use or may be pre-filled as a gift pack.

It should also be noted that the serving apparatus provides a desirable alternative to trays with unsightly pile-ups of toothpicks used by patrons at supermarket deli counters and other public places.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present disclosure.

It is further known that other modifications may be made to the present disclosure, without departing the scope of the apparatus, as noted in the appended claims.

What is claimed is:

1. A portable enclosed food server and refuse receptacle container for displaying and serving food that provides a location for shells and refuse separate from food, comprising an upper open food server member having a peripheral wall extending upwardly from an upper surface, said upper surface comprising a food accommodating shelf, said upper open food server member joinable at a continuous common peripheral edge thereof to a self-standing lower closed refuse receptacle base member having a hollow, unencumbered interior space, said self-standing lower closed refuse receptacle base member having a tapered outer surface tapering from a wide top edge down to a smaller bottom base, said smaller bottom base directly standable upon a table, said joined upper open food server and said self-standing lower closed receptacle base member forming a joined closed container, said food server having at least one chute extending upwardly above said upper surface of said upper open food server member; said at least one chute extending downwardly towards said base member through at least one aperture in said upper surface; said lower closed base receptacle member having a predetermined height at its highest point being significantly less than a predetermined width of said upper open food server member; and said portable enclosed food server and refuse receptacle container having a geometric shape being dimensioned of a pre-determined maximum portable size for being carried by hand by a user.

2. A server apparatus as in claim 1 wherein said chute is removably attached to said server member.

3. A server apparatus as in claim 1 wherein said base member is removably attached to said server member.

4. A server apparatus as in claim 1 wherein said chute and said base member are each removably attached to said server member.

5. A server apparatus of claim 1, wherein said server member has at least one aperture which passes through upper and lower surfaces of said server member.

6. A server apparatus of claim 5, wherein said upper surface of said server member is segmented.

7. A server apparatus of claim 5, wherein said server member includes raised edges on said upper surface.

8. A server apparatus of claim 5, wherein said server member is multi-tiered.

9. A server apparatus of claim 5, wherein said server member has ridges on its lower surface.

10. A server apparatus of claim 5 wherein said chute is positioned on said aperture of said server member.

11. A server apparatus of claim 10, wherein said chute receives food refuse.

12. A server apparatus of claim 11, wherein said chute is snapped into said aperture of said server member.

13. A server apparatus of claim 11 having means wherein said chute is screwed into said aperture of said server member.

14. A server apparatus of claim 11 wherein said chute interlocks into said aperture of said server member.

15. A server apparatus of claim 11 wherein said server member is positioned on upper edges of said base member.

16. A server apparatus of claim 15 wherein said base member is of a sufficient depth to contain a quantity of food refuse.

17. A server apparatus of claim 16 wherein said base member includes a disposable lining.

18. A server apparatus of claim 16 wherein said base member has a non-skid surface on an exterior surface.

19. A server apparatus of claim 16 wherein said base member has at least one handle.

20. A server apparatus of claim 16, wherein said base member includes at least one gripping surface on an exterior surface.

21. A server apparatus of claim 16 wherein said server member is interlocking with said upper edges of said base member.

22. A server apparatus of claim 15, further comprising a heating means.

23. A server apparatus of claim 15, further comprising a cooling means.

24. A server apparatus of claim 15, further comprising an Illumination means.

25. A server apparatus of claim 15, further comprising at least one cover for said server member.

26. A server apparatus of claim 15, further comprising removably attached utensil pockets.

27. A server apparatus of claim 15, further comprising at least one viewing window.

28. A server apparatus of claim 27, wherein said viewing window is opaque, translucent, or transparent.

29. A server apparatus of claim 15, wherein said server apparatus is formed of a food compatible material.

30. A server apparatus of claim 29, wherein said server apparatus is opaque, translucent, or transparent.

31. A server apparatus of claim 29, wherein said server apparatus is decorated for a theme.

32. A server apparatus of claim 29, wherein said server apparatus is formed in any convenient shape.

33. The food server apparatus as in claim 1 wherein said at least one chute extends beyond a lower surface of said server member to guide the shells and refuse into said base member.

34. A server apparatus, for displaying and serving food that provides a location for shells and refuse separate from food, comprising a food server member, at least one chute extending upwardly above an upper surface of said food server member; and a base member attached to said food server member, wherein said server member has at least one aperture which passes through upper and tower surfaces of said server member, wherein said chute is positioned on said aperture of said server member, wherein said chute receives food refuse, wherein said server member is positioned on upper edges of said base member, wherein said base member is of a sufficient depth to contain a quantity of food refuse, wherein said base member includes a conical portion within said base member, said conical member located below said aperture of said chute of the base member, said conical member deflecting shells and refuse to settle in an outer portion of said base member, thereby preventing clogging of said base member at a region thereof located below said chute.

35. A server apparatus of claim 34, wherein said conical portion includes a plurality of vertical slants.

36. A portable food serving container comprising:

an upper food server member to hold food items thereon;

said upper food server member with a continuous peripheral side wall of a height sufficient to keep the food items from falling off, at least one aperture on an upper surface of said upper food server member, with at least one chute extending through said aperture in said upper surface; and wherein, said upper food server member positioned above a lower base member, said lower base member having a bottom and at least one side wall of a sufficient depth to contain discarded portions of the food items therein, said food serving container functioning to allow a user to take a food item from said upper food server member and discard a portion of the food item through said chute into said lower base member;

said lower base member having a hollow, unencumbered interior space, said self-standing lower closed refuse receptacle base member having a tapered outer surface tapering from a wide top edge down to a smaller bottom base, and, said smaller bottom base directly standable upon a table, said upper food server member and said lower base member joined at a common edge therebetween; said lower base member having a predetermined height at its highest point being significantly less than a predetermined width of said upper food server member; and said portable food serving container having a geometric shape being dimensioned of a pre-determined maximum portable size for being carried by hand by a user.

37. The food serving container as described in claim 36, having an aperture located at a previously-determined area of said base portion for emptying discarded portions of the food items, said base portion further comprising a removable cover for said aperture. member to guide the shells and refuse into said base member.

38. The food server container as in claim 36 wherein said at least one chute extends beyond a lower surface of said server member to guide the shells and refuse into said base member.

39. The container as in claim 36 further comprising at least one condiment containing compartment extending upward from said food server member.

40. A portable enclosed food server and refuse receptacle container for displaying and serving food that provides a location for shells and refuse separate from food, comprising an upper open food server member having a peripheral wall extending upwardly from an upper surface, said upper surface comprising a food accommodating shelf and work area, said upper open food server member joinable at a continuous common peripheral edge thereof to a lower closed refuse receptacle base member, said lower base member having a hollow, unencumbered interior space, said self-standing lower closed refuse receptacle base member having a tapered outer surface tapering from a wide top edge down to a smaller bottom base, said smaller bottom base directly standable upon a table, said joined upper open food server and said self-standing lower closed receptacle base member forming a joined closed container, said food sewer having at least one chute extending upwardly above said upper surface of said upper open food server member; said at least one chute extending downwardly towards said base member through at least one aperture in said upper surface; said base member having a predetermined height at its highest point being significantly less than a predetermined width of said server member; and said portable enclosed food server and refuse receptacle container having a geometric shape being dimensioned of a pre-determined maximum portable size for being carried by hand by a user.

41. The portable enclosed food server and refuse receptacle container of claim 40 in which said base member is in the shape of a bowl with a concave interior.

42. The portable enclosed food server and refuse receptacle container of claim 41 in which said chute is in the shape of a bowl with a concave interior with an opening in a bottom thereof for the deposit of refuse.

* * * * *